US011885250B1

(12) United States Patent
Ramappan et al.

(10) Patent No.: US 11,885,250 B1
(45) Date of Patent: Jan. 30, 2024

(54) VEHICLE SYSTEMS AND METHODS FOR AFTERTREATMENT PREHEATING

(71) Applicant: GM GLOBAL TECHNOLOGY OPERATIONS LLC, Detroit, MI (US)

(72) Inventors: Vijay A. Ramappan, Novi, MI (US); Rafat F. Hattar, Royal Oak, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/315,191

(22) Filed: May 10, 2023

(51) Int. Cl.
*F01N 3/20* (2006.01)

(52) U.S. Cl.
CPC .... *F01N 3/2013* (2013.01); *F01N 2900/0602* (2013.01); *F01N 2900/08* (2013.01); *F01N 2900/104* (2013.01); *F01N 2900/1602* (2013.01)

(58) Field of Classification Search
CPC ..... F01N 3/2013; F01N 2900/0602; F01N 2900/08; F01N 2900/104; F01N 2900/1602
See application file for complete search history.

(56) References Cited

U.S. PATENT DOCUMENTS 5,370,871 A 12/1994 Dintzis et al.
5,519,992 A * 5/1996 Hosoya ..... F01N 3/22 60/284
5,637,204 A 6/1997 Botte et al.
6,568,173 B1 5/2003 Kolmanovsky et al.
6,834,496 B2 12/2004 Nakatani et al.
7,104,051 B2 9/2006 Shimasaki et al.
7,316,157 B2 1/2008 Ohsaki
8,099,953 B2 1/2012 DeHart
9,146,210 B2 9/2015 Gibson et al.
10,167,795 B2 1/2019 Disaro et al.
10,233,871 B2 3/2019 Huang et al.
10,598,109 B2 3/2020 Mehta et al.
2010/0139267 A1 6/2010 Schliesche et al.
2011/0225955 A1 9/2011 Kimura et al.
2011/0305601 A1* 12/2011 Kawase ..... F01N 3/2026 422/109

(Continued)

FOREIGN PATENT DOCUMENTS

CN 204099006 U 1/2015
DE 4106249 A1 9/1991

(Continued)

*Primary Examiner* — Brandon D Lee
(74) *Attorney, Agent, or Firm* — Lorenz & Kopf LLP

(57) ABSTRACT

Vehicle systems and methods are provided for preheating an aftertreatment system prior to engine ignition. A method involves obtaining a first measurement indicative of a current temperature associated with the aftertreatment system, obtaining a second measurement indicative of a current state of an energy source coupled to a heating element integrated with the aftertreatment system, determining an amount of electrical energy to be applied to the heating element based at least in part on a difference between the current temperature associated with the aftertreatment system and a target temperature for the aftertreatment system, and automatically enabling current flow from the energy source to the heating element prior to ignition of the engine for a duration of time in a manner that is influenced by the amount of electrical energy to be applied to the heating element and the current state of the energy source.

16 Claims, 6 Drawing Sheets

(56) References Cited

U.S. PATENT DOCUMENTS

| | | | | |
|---|---|---|---|---|
| 2017/0120756 | A1 | 5/2017 | Yokoyama et al. | |
| 2017/0145937 | A1* | 5/2017 | Tsurumi | B66C 13/54 |
| 2018/0163592 | A1* | 6/2018 | Hirooka | F01N 3/20 |
| 2019/0271253 | A1* | 9/2019 | Hirooka | B60W 20/16 |
| 2019/0331015 | A1* | 10/2019 | Naumann | F01N 3/2026 |
| 2021/0189936 | A1* | 6/2021 | Korenaga | F01N 9/00 |
| 2023/0129655 | A1* | 4/2023 | Steigert | F01N 13/009 219/205 |

FOREIGN PATENT DOCUMENTS

| | | | |
|---|---|---|---|
| EP | 2058504 | A2 | 5/2009 |
| GB | 2522130 | A | 7/2015 |
| JP | 2001342911 | A | 12/2001 |

* cited by examiner

VEHICLE SYSTEMS AND METHODS FOR AFTERTREATMENT PREHEATING

INTRODUCTION

The technical field generally relates to vehicle systems and more particularly relates to preheating a catalytic converter or other aftertreatment system for automotive applications.

Many vehicles rely on combustion engines for propulsion. Combustion results in exhaust gases emitted from the engine that include, but are not limited to, carbon monoxide, carbon dioxide, unburned hydrocarbons, oxides of nitrogen (NOx), and oxides of sulfur (SOx), as well as condensed phase materials (liquids and solids) that constitute particulate matter. Exhaust gas treatment systems typically employ catalysts in a catalytic converter, emissions control device or component of an aftertreatment system in order to reduce exhaust gas emissions. Exhaust gas interacting with the catalyst converts exhaust constituents into more tolerable exhaust constituents, such as, for example, nitrogen and water. However, catalysts employed for emissions controls typically exhibit suboptimal performance below a so-called "light off" temperature, above which the catalyst is more catalytically active or efficient. Since a disproportionate amount of emissions are attributable to engine operation at startup, alternatively referred to as cold start emissions, it is desirable to achieve catalyst light off temperature prior to ignition.

SUMMARY

Vehicle systems and methods are provided for preheating an aftertreatment system downstream of an engine of a vehicle prior to ignition of the engine. One method involves a control module associated with a vehicle obtaining a first measurement indicative of a current temperature associated with the aftertreatment system, obtaining a second measurement indicative of a current state of an energy source coupled to a heating element integrated with the aftertreatment system, determining an amount of electrical energy to be applied to the heating element based at least in part on a difference between the current temperature associated with the aftertreatment system and a target temperature for the aftertreatment system, and automatically enabling current flow from the energy source to the heating element prior to ignition of the engine for a duration of time in a manner that is influenced by the amount of electrical energy to be applied to the heating element and the current state of the energy source.

In one aspect, automatically enabling the current flow involves the control module automatically operating a switching arrangement coupled between the energy source and the heating element for the duration of time with a duty cycle, where the control module determines the duty cycle based at least in part on the current state of the energy source and the difference between the current temperature associated with the aftertreatment system and the target temperature for the aftertreatment system. In one implementation, determining the duty cycle involves the control module determining the duty cycle to minimize the duration of time for applying the amount of electrical energy based on the current state of the energy source. In another implementation, determining the duty cycle involves the control module determining the duty cycle based at least in part on an overheating threshold temperature associated with the heating element.

In another aspect, the method involves automatically enabling an auxiliary air injection device to provide fluid flow past the heating element through the aftertreatment system after enabling the current flow from the energy source to the heating element. In one implementation, the control module determines a temperature associated with the heating element is greater than a threshold prior to automatically enabling the auxiliary air injection device. In another implementation, the control module determines a duty cycle for operating the auxiliary air injection device based at least in part on the current temperature associated with the aftertreatment system, wherein automatically enabling the auxiliary air injection device involves operating the auxiliary air injection device with the duty cycle.

In one implementation, the method involves the control module detecting a potential startup condition for the engine, identifying the duration of time based on a type of the potential startup condition, and determining a duty cycle for the current flow from the energy source to the heating element to achieve the amount of electrical energy based at least in part on the duration of time and the current state of the energy source, wherein automatically enabling the current flow involves automatically operating a switching arrangement coupled between the energy source and the heating element with the duty cycle for the duration of time. In another implementation, the heating element is a resistive element contained within a housing of an emissions control device of the aftertreatment system. In some implementations, the resistive element is disposed upstream of a catalyst component within the housing of the emissions control device and the target temperature is a targeted light off temperature associated with the catalyst component. In one aspect, obtaining the first measurement involves obtaining the first measurement from a temperature sensing element within the housing of the emissions control device, wherein the temperature sensing element is upstream of at least one of the resistive element and the catalyst component.

A vehicle system is provided that includes an energy source, an emissions control device including a heating element coupled to the energy source and at least one catalyst component, a temperature sensing element to obtain a first measurement indicative of a current temperature associated with the emissions control device, and a control module coupled to the heating element and the energy source. The control module is configurable to detect a potential startup condition for an engine upstream of the emissions control device, obtain a second measurement indicative of a current state of the energy source, determine an amount of electrical energy to be applied to the heating element based at least in part on a difference between the current temperature and a target temperature for the at least one catalyst component, and automatically enable current flow from the energy source to the heating element for a duration of time in a manner that is influenced by the amount of electrical energy to be applied to the heating element and the current state of the energy source. In one aspect, the control module is configurable to determine a duty cycle for operating the heating element based at least in part on the current state of the energy source and automatically enable the current flow by operating a switching arrangement between the energy source and the heating element in accordance with the duty cycle determined based at least in part on the current state of the energy source. In another aspect, the control module is configurable to determine the duty cycle to minimize the duration of time for achieving the amount of electrical energy applied to the heating element based at least in part on a current voltage of the energy source. In one implementation, the control module is configurable to maximize the duty cycle based at least in part on an overheating threshold temperature associated with the heating element.

In another implementation, the vehicle system includes an auxiliary air injection device upstream of the emissions control device to provide a fluid flow through the emissions control device, wherein the control module is coupled to the auxiliary air injection device and configurable to automatically enable the auxiliary air injection device to provide the fluid flow after enabling the current flow from the energy source to the heating element. In one implementation, the control module is configurable to verify a temperature associated with the heating element is greater than a threshold prior to automatically enabling the auxiliary air injection device. In another implementation, the control module is configurable to determine a duty cycle for operating the auxiliary air injection device based at least in part on the current temperature and operate the auxiliary air injection device with the duty cycle.

An apparatus for a non-transitory computer-readable medium is also provided. The non-transitory computer-readable medium has executable instructions encoded or stored thereon that, when executed by a processor, cause the processor to provide an aftertreatment system preheating service configurable to obtain a first measurement indicative of a current temperature associated with an aftertreatment system downstream an engine of a vehicle, obtain a second measurement indicative of a current state of an energy source coupled to a heating element integrated with the aftertreatment system, determine an amount of electrical energy to be applied to the heating element based at least in part on a difference between the current temperature associated with the aftertreatment system and a target temperature for the aftertreatment system, and automatically enable current flow from the energy source to the heating element for a duration of time prior to ignition of the engine in a manner that is influenced by the amount of electrical energy to be applied to the heating element and the current state of the energy source. In one implementation, the aftertreatment system preheating service is configurable to verify a temperature associated with the heating element is greater than a threshold after enabling the current flow, and after verifying the temperature associated with the heating element is greater than the threshold, determine a duty cycle for operating an auxiliary air injection device based at least in part on the current temperature associated with the aftertreatment system and automatically operate the auxiliary air injection device with the duty cycle.

BRIEF DESCRIPTION OF THE DRAWINGS

The exemplary aspects will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding introduction, summary, or the following detailed description. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
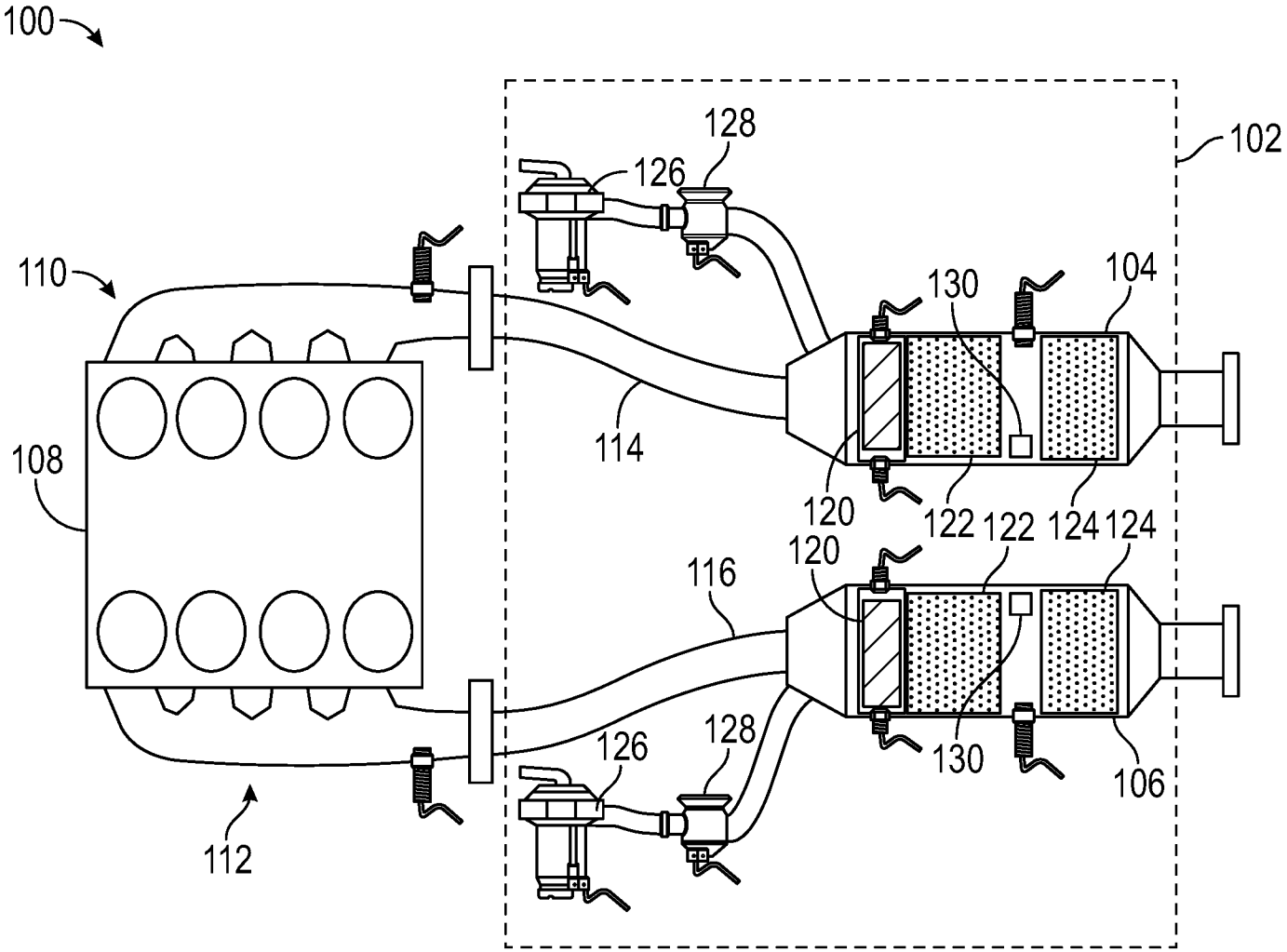
FIG. 1 is a block diagram illustrating a vehicle system in accordance with various implementations.

FIG. 1 depicts a layout of an exemplary vehicle system 100 having an exhaust gas aftertreatment system 102 that includes a pair of emissions control devices 104, 106 downstream of an engine 108. In this regard, FIG. 1 depicts an implementation of an engine 108 having a V-type cylinder arrangement (e.g., a V8 internal combustion engine (ICE)) having separate exhaust manifolds 110, 112, where each exhaust manifold 110, 112 is in fluid communication with a respective one of the emissions control devices 104, 106 via a respective duct or conduit 114, 116 for directing exhaust gas flow exiting the respective manifold 110, 112 to the inlet or intake of a respective emissions control device 104, 106. It should be appreciated that the subject matter described herein is not limited to any particular type or configuration of engine or any particular type or configuration of vehicle; however, for purposes of explanation, the subject matter will be described in the context of an internal combustion engine (ICE) used for propulsion of an automotive vehicle, such as, for example, a V8 engine suitable for use in a passenger car, sedan, van, truck, sport utility vehicle (SUV), recreational vehicle (RV) or the like.

In exemplary implementations, the emissions control devices 104, 106 are realized as duplicate instances of a catalytic converter including an electrically heated catalyst. In the illustrated implementation in FIG. 1, the emissions control devices 104, 106 include respective instances of a heating element 120 integrated with or otherwise contained within the housing of the respective emissions control devices 104, 106 upstream of respective instances of catalyst components (or catalysts) 122, 124. Each catalyst component 122, 124 may include or otherwise be realized as a substrate having a chemical compound, composition or other coating applied to the substrate that is configured to chemically react with compounds or constituents within the exhaust gas flow to convert those compounds or exhaust gas constituents into other substances, thereby detoxifying the exhaust gas flow prior to emission. Depending on the implementation, the respective catalyst components 122, 124 may be identical to one another or different from one another. For example, in some implementations, the first stage catalyst components 122 may be realized as 3-way catalysts while the second stage catalyst components 124 are realized as 4-way catalysts, or vice versa. As described in greater detail below, the heating elements 120 are operated prior to ignition or starting of the engine 108 to proactively increase the temperature of the catalyst components 122, 124 in anticipation of a startup event, and thereby improve the performance and efficiency of the emissions control devices 104, 106 with respect to so-called cold start emissions.

In exemplary implementations, the aftertreatment system 102 also includes respective instances of an auxiliary air injection device 126 that is upstream of the emissions control devices 104, 106 via an auxiliary duct or conduit between the outlet of a respective auxiliary air injection device 126 and the inlet or intake of the respective emissions control device 104, 106. In this regard, exemplary implementations include a respective valve 128 disposed within an auxiliary conduit between the respective auxiliary air injection device 126 and the inlet of the respective emissions control device 104, 106 to selectively enable or disable fluid flow between the auxiliary air injection device 126 and the emissions control device 104, 106. In exemplary implementations, the auxiliary air injection device 126 is realized as an air compressor or similar air pump that is operable to compress and direct ambient air into the respective emissions control device 104, 106 via the auxiliary conduit and valve 128. As described in greater detail below, the auxiliary air injection devices 126 are operated after activation of the heating elements 120 but prior to ignition or starting of the engine 108 to provide fluid flow through the emissions control devices 104, 106 that heat the catalyst components 122, 124 by virtue of the upstream heating element 120 heating the fluid flow before reaching the catalyst components 122, 124. In this regard, the operation of the heating elements 120 and the auxiliary air injection devices 126 may be cooperatively configured to minimize the duration of time required to heat the catalyst components 122, 124 to temperatures that are greater than or equal to the threshold light off temperature for achieving a desired level of efficiency of the catalyst components 122, 124.

Still referring to FIG. 1, in exemplary implementations, the emissions control devices 104, 106 include temperature sensing elements 130 (or temperature sensors) that are integrated with, disposed within or otherwise contained within the housing of the respective emissions control devices 104, 106 to obtain temperature measurement values indicative of the current temperature associated with the aftertreatment system 102, that is, the temperature of the gas flow within the respective emissions control devices 104, 106. Additionally, the vehicle system 100 may include temperature sensing elements (or temperature sensors) configured to obtain temperature measurement values indicative of the current temperature associated with the exhaust gas flow. In this regard, depending on the implementation, the temperature sensing elements may be integrated with, disposed within or otherwise contained within the exhaust manifolds 110, 112 and/or the exhaust conduits 114, 116 to obtain a measurement of the exhaust gas flow upstream of the emissions control devices 104, 106.

Although not illustrated in FIG. 1, as described in greater detail below, in exemplary implementations, a control module or other computing device is coupled to the heating elements 120, the auxiliary air injection devices 126, the valves 128 and the temperature sensing elements 130 and is configurable to operate the heating elements 120, the auxiliary air injection devices 126 and the valves 128 in a manner that is influenced by the temperature measurements obtained via the temperature sensing elements 130 to efficiently preheat the emissions control devices 104, 106 prior to startup of the engine 108. In this regard, the control module or computing device that operates the heating elements 120, the auxiliary air injection devices 126 and the valves 128 may be implemented or realized using any sort of electronic component onboard the vehicle that includes at least one processor and data storage element, including, but not limited to, a system on a chip, integrated circuit or another electronics module. The processor can include or be realized as any custom made or commercially available processor, a central processing unit (CPU), a graphics processing unit (GPU), an auxiliary processor among several processors associated with the control module, a semiconductor-based microprocessor (in the form of a microchip or chip set), a macroprocessor, any combination thereof, or generally any device for executing instructions. The data storage element includes or is otherwise realized as a non-transitory computer readable storage device or media, which may include volatile and nonvolatile storage in read-only memory (ROM), random-access memory (RAM), and keep-alive memory (KAM). For example, the data storage element may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the processor. The instructions may include one or more separate programs, each of which comprises an ordered listing of executable instructions for implementing logical functions. The instructions, when executed by the processor, cause the processor to support or otherwise provide an aftertreatment system preheating service and perform logic, calculations, methods and/or algorithms for supporting the subject matter described herein.

Figure 2:
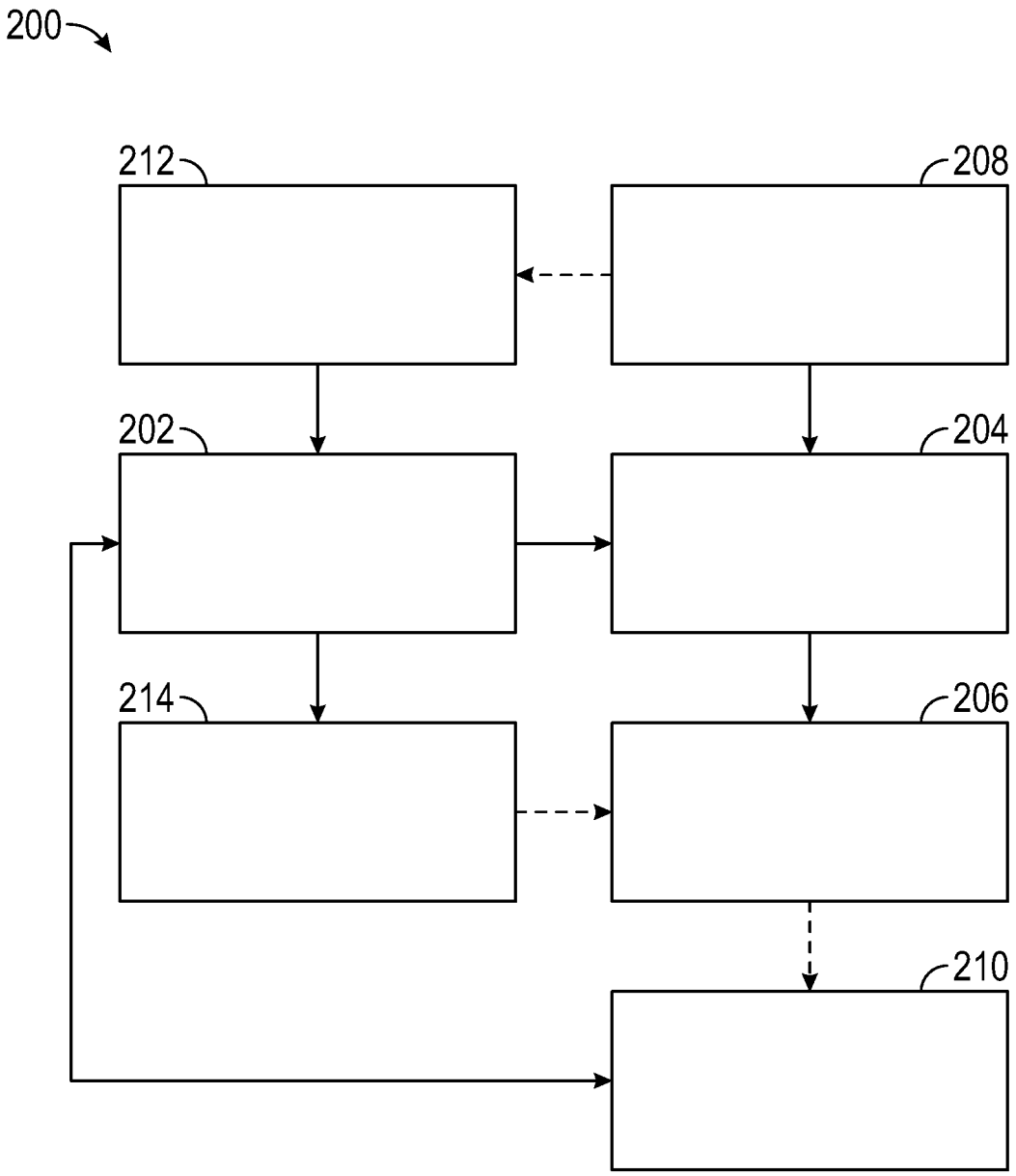
FIG. 2 is a block diagram illustrating a control system suitable for use with a vehicle system in accordance with various implementations.

FIG. 2 depicts an exemplary implementation of a control system 200 suitable for use with the vehicle system 100 of FIG. 1 to support preheating of the aftertreatment system 102. The control system 200 includes a control module 202 that includes, incorporates or is otherwise coupled to a switching arrangement 204 that is operable to enable electrical current flow to a heating element 206 integrated with an emissions control device (e.g., heating element 120) from an energy source 208 associated with the vehicle. In this regard, the energy source 208 generally represents a battery (or battery pack) onboard the vehicle that supplies power to a so-called low voltage electrical grid onboard the vehicle, such as, for example, a 12 Volt battery, an 18 Volt battery, and/or the like. However, it should be appreciated the subject matter is not limited to any particular type of energy source 208 and may be implemented in an equivalent manner in the context of any type of energy source, including, but not limited to, a high voltage battery, an ultracapacitor, a fuel cell or the output of a rectifier, DC-to-DC converter or any other power converter. That said, for purposes of explanation, the subject matter will be described herein in the context of the energy source 208 being realized as a low voltage battery.

In exemplary implementations, the heating element 206 includes or is otherwise realized using one or more resistors or similar resistive elements capable of dissipating electrical current or power from the energy source 208, and thereby, generating heat that elevates the temperature of the heating element 206. That said, the heating element 206 is not limited to any particular type of electrical components, circuitry or configurations, and may vary depending on the implementation.

The switching arrangement 204 generally represents one or more transistors or other switching elements coupled or otherwise arranged electrically in series between the energy source 208 and the heating element 206 to enable or disable current flow between the energy source 208 and the heating element 206, and thereby control activation of the heating element 206. It should be noted that although FIG. 2 depicts the switching arrangement 204 as separate from the control module 202, in practice, the switching arrangement 204 may be integrated or otherwise combined with the control module 202.

As described above, the control module 202 can be implemented or realized using any sort of electronic component onboard the vehicle that includes at least one processor and data storage element, where the data storage element stores or otherwise maintains executable instructions that, when executed by the processor, cause the processor to support or otherwise provide an aftertreatment system preheating service and support the subject matter described herein. As illustrated in FIG. 2, the control module 202 is communicatively coupled to one or more temperature sensing elements 210 (or temperature sensors) that are configured to provide temperature measurement values indicative of the current temperature associated with the emissions control devices of the aftertreatment system (e.g., temperature sensors 130). Additionally, the control module 202 is coupled to other sensing elements 212 to provide measurement values indicative of other characteristics or conditions associated with the vehicle system, such as, for example, temperature sensors to provide measurements indicative of the exhaust gas temperature, temperature sensors to provide measurements indicative of the ambient air temperature external to the vehicle, and/or the like along with voltage sensors, current sensors, state of charge (SoC) sensors, or other sensing elements configured to provide measurement values indicative of the current state or condition of the energy source 208. The control module 202 is coupled to an auxiliary air injection device 214 (e.g., auxiliary air injection device 126) and controls operation of the heating element 206 (via switching arrangement 204) and the auxiliary air injection device 214 to efficiently preheat emission control devices of an aftertreatment system (e.g., emissions control devices 104, 106 of the aftertreatment system 102) based on measurement values from the sensors 210, 212 indicative of the current state of the aftertreatment system and/or the vehicle system, as described in greater detail below.

Figure 3:
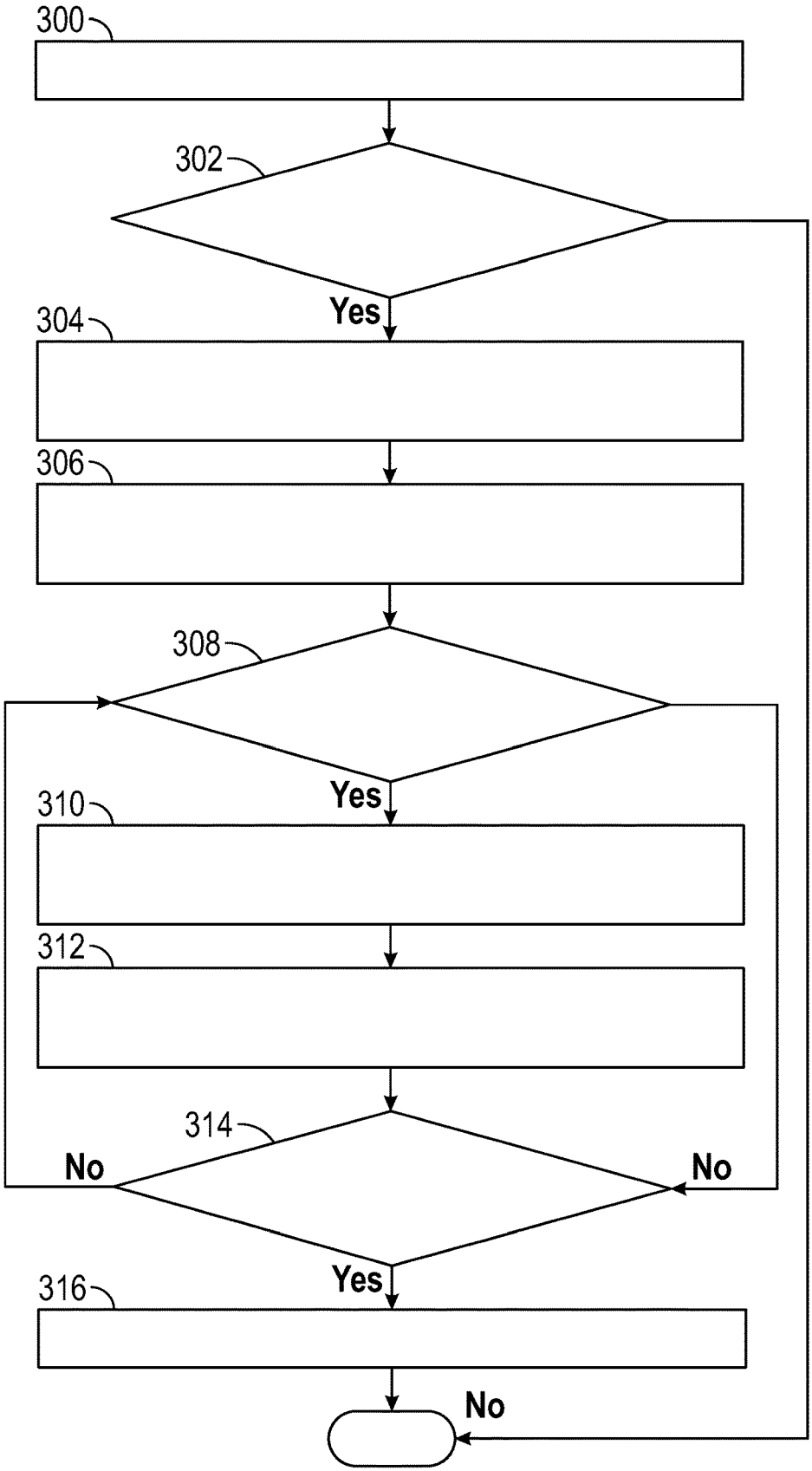
FIG. 3 depicts a flow diagram of an aftertreatment preheating process suitable for implementation in connection with the vehicle system of FIG. 1 according to one or more implementations described herein.

FIG. 3 depicts an exemplary implementation of an aftertreatment preheating process 300 that may be implemented or otherwise performed by an aftertreatment system preheating service at a control module of a vehicle system to efficiently preheat the catalyst or other components associated with emissions control devices prior to ignition of an internal combustion engine and perform additional tasks, functions, and/or operations described herein. For illustrative purposes, the following description may refer to elements mentioned above in connection with FIGS. 1-2. While portions of the aftertreatment preheating process 300 may be performed by different elements of a vehicle system, for purposes of explanation, the subject matter may be primarily described herein in the context of the aftertreatment preheating process 300 being primarily performed by an aftertreatment system preheating service at a vehicle control module 202 that is coupled to the sensing elements 130, 210, 212 and controls operation of the heating elements 120, 206, the auxiliary air injection devices 126, 214 and/or the valves 128.

Referring to FIG. 3 with continued reference to FIGS. 1-2, the aftertreatment preheating process 300 is initiated or otherwise performed in response to detecting a potential startup condition that is indicative of anticipated ignition of the internal combustion engine. For example, as described in U.S. Pat. No. 10,167,795, the potential startup condition could include a vehicle door opening event (e.g., a user opening one of the vehicle trunk, vehicle driver door, vehicle passenger door, etc.), a seat sensor event (e.g., detection of a user occupying the driver seat), a seat belt sensor event (e.g., detection of a driver seat belt, passenger seat belt or the like being engaged), a fob proximity detection event (e.g., when a key fob, a cellular telephone, or other device capable of communicating proximity to the vehicle is within a threshold range of the vehicle), a remote command (e.g., remote start) or the like.

After detecting the potential startup condition, the aftertreatment preheating process 300 verifies or otherwise confirms one or more enablement criteria are satisfied before attempting to preheat the aftertreatment system at 302. For example, the control module 202 may analyze measurement values from one or more sensing elements 212 indicative of the current state or current condition of the energy source 208 to verify the current state of charge associated with the energy source 208 is greater than an enable threshold state of charge. In this manner, when the current state of charge is less than the enable threshold, the aftertreatment preheating process 300 exits or terminates to avoid depletion of the energy source 208 to ensure adequate state of charge remains to support other functionality (e.g., starting the engine 108).

In some implementations, the control module 202 also tracks or otherwise monitors a number of preheating cycles that have been performed between successive operations of the engine 108. In this regard, each time the control module 202 operates the heating element 120, 206 to preheat the aftertreatment system 102, the control module 202 may increment the value of a counter that is reset when the engine 108 is started. When the value of the counter is greater than a threshold number of preheating cycles, the aftertreatment preheating process 300 similarly exits or terminates to avoid depletion of the energy source 208 or potentially unnecessary operation of the heating elements 120, 206 and the air injection device 126, 214, for example, when a user keeps approaching the vehicle or entering and exiting the vehicle without starting the engine 108.

Additionally, in some implementations, the control module 202 also tracks or otherwise monitors a duration of time that has elapsed since the engine 108 was most recently operated to ensure the engine off time is greater than a threshold duration of time within which it is unlikely that both the temperature of the catalyst components 122, 124 will fall below the light off temperature or a threshold temperature required to achieve a desired level of performance and that the user will want to restart the engine 108 within that period of time. The control module 202 may also verify or otherwise confirm that the temperature associated with the emissions control devices 104, 106 is below the light off temperature or another threshold catalyst temperature required to achieve a desired performance of the catalyst components 122, 124. In other words, various implementations of the aftertreatment preheating process 300 may only attempt to preheat the aftertreatment system 102 when the state of charge of the energy source 208 is greater than a threshold, the number of successive preheating cycles is less than a threshold, the engine time off is greater than a threshold, and the current temperature associated with the aftertreatment system 102 is less than the light off temperature or other temperature threshold.

When the enablement criteria for a preheating cycle are satisfied, the aftertreatment preheating process 300 calculates or otherwise determines an amount of electrical energy to be applied to the heating element to raise the catalyst temperature based on current measurement values at 304 and then automatically operates a switching arrangement to activate or otherwise operate the heating element in accordance with the determined amount of electrical energy at 306. In this regard, based on the difference between the current temperature measurement values indicative of the current temperature of the catalyst components 122, 124 obtained from the temperature sensing elements 130, 210 and the targeted light off temperature for the catalyst components 122, 124, the control module 202 may calculate or otherwise determine an amount of electrical power to be applied to the heating element 120, 206 and a corresponding duration of time for which to apply the electrical power to raise the temperature of the catalyst components 122, 124 from the current temperature to the targeted light off temperature at the end of that duration of time. The control module 202 then automatically operates or otherwise activates the switching arrangement 204 to thereby operate or activate the heating elements 120, 206 to cause the heating elements 120, 206 to dissipate or otherwise consume the determined amount of electrical energy over the determined duration of time.

In some implementations, the duration of time is identified or determined based on the type of potential startup condition that was detected, such that different potential startup conditions may utilize different amounts of electrical power to achieve the targeted light off temperature prior to starting the engine 108. For example, detecting an occupant in the driver seat of the vehicle may entail a shorter preheating cycle duration (e.g., because starting the engine 108 is more imminent) than a key fob detection event or a remote start command event where more immediate starting of the engine 108 is less likely. Based upon the anticipated available duration of time for preheating, the control module 202 may calculate or otherwise determine an amount of electrical power to be applied to the heating element 120, 206 within that anticipated available duration of time based on the difference between the current temperature associated with the aftertreatment system 102 and the targeted light off temperature. In this regard, for longer duration preheating cycles, higher initial aftertreatment system temperatures and/or lower targeted light off temperatures, the control module 202 may determine a reduced amount of power is required, while shorter duration preheating cycles, lower initial aftertreatment system temperatures and/or higher targeted light off temperatures may result in an increased amount of power being required.

In exemplary implementations, based on the amount of power required, the control module 202 determines a corresponding duty cycle at which to operate the switching arrangement 204 or may otherwise operate the energy source 208 and/or the heating elements 120, 206 to achieve the desired power consumption over the anticipated available duration of time, resulting in cumulative consumption of the determined amount of electrical energy required to raise the temperature of the catalyst components 122, 124 from the current temperature to the targeted light off temperature. In this manner, the duration of the preheating cycle may be optimized and/or minimized depending on the particular startup condition to increase the likelihood of the preheating cycle completing prior to ignition of the engine 108, with the power consumption being similarly optimized and/or minimized to conserve availability of the energy source 208 and/or reduce wear or stress on the heating elements 120, 206 and/or the switching arrangement 204.

Still referring to FIG. 3, the aftertreatment preheating process 300 determines whether to operate an auxiliary air injection device at 308. In response to determining the auxiliary air injection device should be operated, the aftertreatment preheating process 300 calculates or otherwise determines commands for operating the auxiliary air injection device to raise the catalyst temperature to the targeted light off temperature within the determined duration for the preheating cycle at 310 and then automatically operates or otherwise activates the auxiliary air injection device in accordance with the determined commands at 312. In this regard, depending on the potential startup condition, the current temperature of the emissions control devices 104, 106 and/or potentially other factors, the control module 202 may determine that the auxiliary air injection devices 126, 214 should be operated to generate fluid flow through the emissions control devices 104, 106 to convectively heat the catalyst components 122, 124 within the emissions control devices 104, 106 that are downstream of the heating element 120, 206. For example, when the duty cycle associated with the operation of the switching arrangement 204 and/or the heating elements 120, 206 is greater than a threshold (e.g., a duty cycle greater than 90%), the control module 202 may determine that the auxiliary air injection devices 126, 214 should be operated to prevent overheating of the heating elements 120, 206 and/or to increase heat transfer to the downstream catalyst components 122, 124 to increase the likelihood of reaching the targeted light off temperature prior to ignition. In this regard, when the duration of the preheating cycle is relatively short, the auxiliary air injection devices 126, 214 may be operated to increase the rate at which the downstream catalyst components 122, 124 are heated, and thereby, increase the likelihood of the downstream catalyst components 122, 124 achieving the targeted light off temperature (e.g., if the engine 108 is prematurely started before completion of the preheating cycle).

Similar to the heating elements 120, 206 and the switching arrangement 204, in exemplary implementations, the control module 202 calculates or otherwise determines a duty cycle for using pulse-width modulated (PWM) commands to operate the auxiliary air injection devices 126, 214 based at least in part on the current temperature associated with the emissions control devices 104, 106 and may vary the duty cycle for operating the auxiliary air injection devices 126, 214, and thereby vary the rate of fluid flow past the heating elements 120, 206 during the preheating cycle. For example, when the measured temperature of the emissions control devices 104, 106 obtained via the integrated sensing elements 130, 210 is relatively lower, the control module 202 may operate the auxiliary air injection devices 126, 214 with a lower duty cycle (e.g., to limit heat transfer and allow the temperature of the heating element 120, 206 to increase) than when the measured temperature of the emissions control devices 104, 106 is greater, at which point the control module 202 may operate the auxiliary air injection devices 126, 214 with an increased duty cycle to increase fluid flow, and thereby, increase convective heat transfer from the heating element 120, 206 to the downstream catalyst components 122, 124.

Still referring to FIG. 3, the aftertreatment preheating process 300 continues by operating the heating element and/or auxiliary air injection device until detecting or otherwise identifying a termination condition at 314 and then deactivating the preheating components at 316. In this regard, depending on the current measurements or other data or information obtained via the various sensing elements 130, 210, 212, the control module 202 may maintain operation of the heating element 120, 206 and the auxiliary air injection device 214 for the duration of the preheating cycle and/or until one or more termination criteria are satisfied prior to the preheating cycle elapsing. For example, in response to detecting a current temperature associated with the aftertreatment system 102 and/or the exhaust gas flow that is greater than the targeted light off temperature, the control module 202 may terminate operation of the heating element 120, 206 and the auxiliary air injection device 214. In some implementations, the control module 202 may terminate operation of the heating element 120, 206 and the auxiliary air injection device 214 in response to detection ignition of the engine 108. That said, in other implementations, the control module 202 may maintain operation of at least one of the heating element 120, 206 and the auxiliary air injection device 214 after ignition of the engine 108 until the termination criteria are satisfied. For example, when the current temperature of the exhaust gas obtained via sensing elements is greater than the ambient air temperature, the control module 202 may terminate operation of the auxiliary air injection device 126, 214 and close the valves 128 once the exhaust gas becomes more effective at heating the catalyst components 122, 124.

Figure 4:
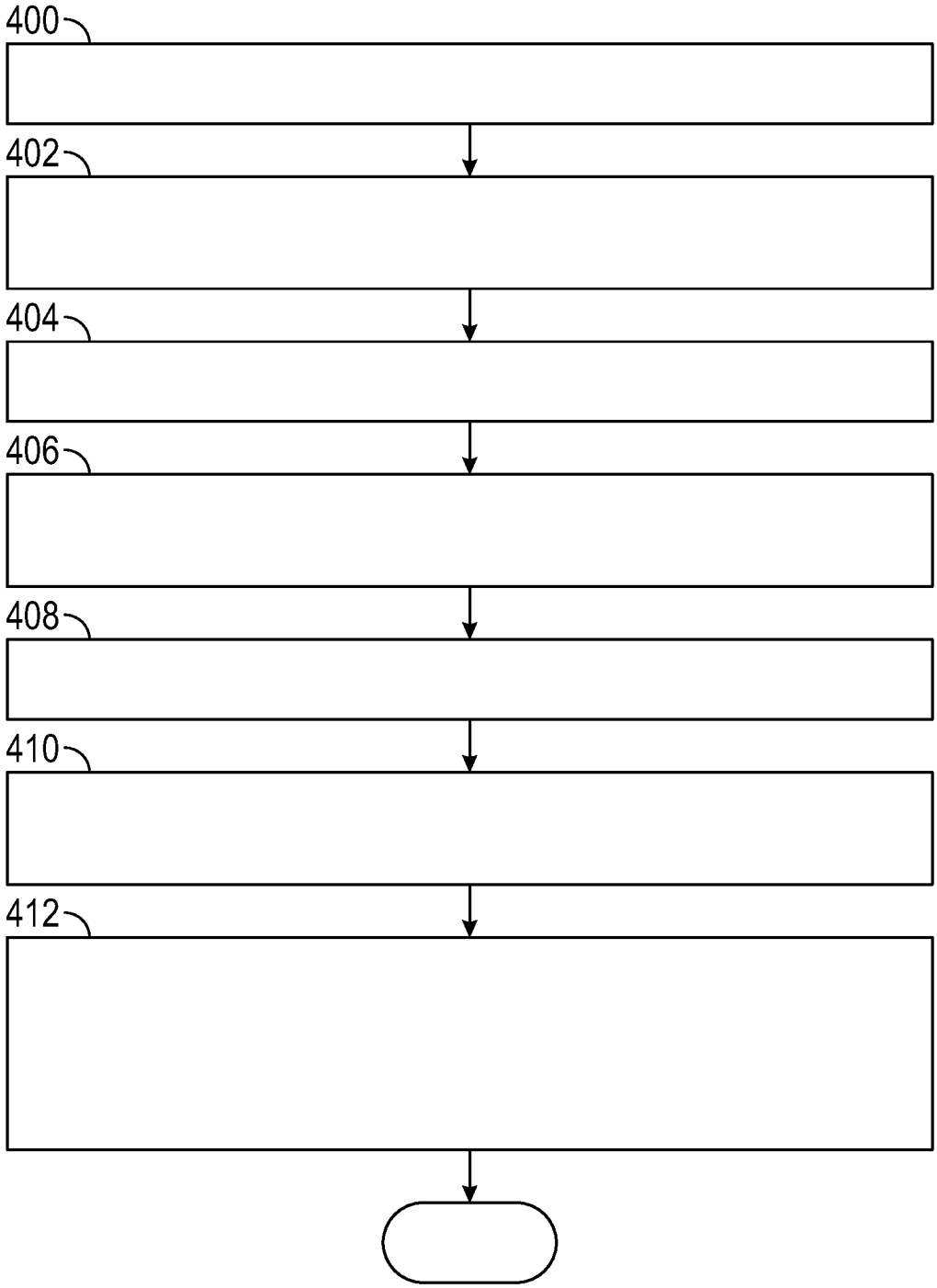
FIG. 4 depicts a flow diagram of an electrical preheating process suitable for implementation in connection with the aftertreatment preheating process of FIG. 3 according to one or more implementations described herein.

FIG. 4 depicts an exemplary implementation of an electrical preheating process 400 that may be implemented or otherwise performed in connection with the aftertreatment preheating process 300 (e.g., at 304) to determine how to operate an electrical heating element for preheating catalysts or other components associated with emissions control devices and perform additional tasks, functions, and/or operations described herein. For illustrative purposes, the following description may refer to elements mentioned above in connection with FIGS. 1-2. For purposes of explanation, the subject matter may be primarily described herein in the context of the electrical preheating process 400 being primarily performed by the aftertreatment system preheating service at the vehicle control module 202.

The electrical preheating process 400 initializes or begins after detecting a potential startup condition and verifying enablement criteria have been satisfied for preheating the aftertreatment system (e.g., at 302). The electrical preheating process 400 identifies or otherwise obtains one or more measurement values indicative of the current temperature associated with the aftertreatment system at 402 and corresponding target temperature values for the aftertreatment system at 404. In this manner, the difference between the current temperature of the emissions control devices 104, 106 obtained via the sensing elements 130, 210 and the targeted light off temperature for the catalyst components 122, 124 influences the duration and manner in which the electrical heating element 120, 206 is operated. For example, the aftertreatment system preheating service at the vehicle control module 202 may utilize the difference in temperature between the measured current temperature associated with the emissions control devices 104, 106 and the targeted light off temperature to calculate or otherwise determine an amount of thermal energy transfer required to achieve the targeted light off temperature.

The electrical preheating process 400 also identifies or otherwise obtains one or more measurement values indicative of the current state of the energy source at 406. In this regard, the aftertreatment system preheating service at the vehicle control module 202 may obtain measurements indicative of the current voltage and/or the current state of charge associated with the energy source 208 via one or more sensing elements 212. Based on the current voltage and/or the current state of charge associated with the energy source 208, the aftertreatment system preheating service at the vehicle control module 202 varies one or more of the duty cycle for operating the switching arrangement 204 and/or the duration of the preheating cycle for which the switching arrangement 204 is operated to achieve a desired power flow for achieving the desired amount of thermal energy transfer within a particular amount of time. In exemplary implementations, electrical preheating process 400 also identifies or otherwise obtains information characterizing or quantifying the impedance associated with the electrical heating element at 408 along with information characterizing or quantifying one or more overheating threshold temperatures associated with the electrical heating element at 410. In this regard, the overheating threshold temperatures represent a maximum temperature threshold above which the heating element 120, 206 may be susceptible to damage due to thermal stress.

At 412, the electrical preheating process 400 calculates or otherwise determines commands for operating the electrical heating element with a particular duty cycle for a particular duration of time based at least in part on the difference between the current temperature of the aftertreatment system and the targeted temperature for the aftertreatment system in a manner that is influenced by one or more of the current energy source conditions, the impedance of the heating element and the overheating threshold(s) associated with the heating element. For example, the aftertreatment system preheating service may utilize the impedance of the heating element 120, 206 and the overheating temperature threshold (s) to calculate or otherwise determine a maximum current flow through the heating element 120, 206 that prevents overheating. Based on the maximum current flow and the current voltage of the energy source 208, the aftertreatment system preheating service may calculate or otherwise determine a maximum duty cycle for operating the switching arrangement 204 to achieve a resulting current flow through the heating element 120, 206 that is less than or equal to the maximum current flow. In this manner, the aftertreatment system preheating service determines a duty cycle for operating the switching arrangement 204 that maximizes heating of the catalyst components 122, 124 while avoiding overheating the heating element 120, 206. Based on the required amount of thermal energy transfer for reaching the targeted light off temperature, the aftertreatment system preheating service may then calculate or otherwise determine a preheating cycle duration for which the determined duty cycle should be applied until achieving the amount of heat transfer required to reach the targeted light off temperature. In this regard, some implementations of the electrical preheating process 400 may optimize preheating by maximizing the duty cycle and minimizing the preheating cycle duration given the current energy source conditions without overheating.

In yet other implementations, the aftertreatment system preheating service may identify or otherwise determine the preheating cycle duration based on the type of detected startup condition that triggered the aftertreatment preheating process 300, and then optimize the duty cycle or energy transfer rate for that particular preheating cycle duration. For example, certain types of potential startup conditions (e.g., driver seat occupancy or driver seat belt engagement) may be more indicative of an imminent ignition event that requires a shorter preheating cycle, while other potential startup conditions (e.g., proximity detection of a key fob) may have a more relaxed preheating cycle duration. Based on the particular preheating cycle duration assigned to the detected startup condition, the aftertreatment system preheating service may divide the estimated amount of thermal energy transfer required based on the difference between the current temperature of the aftertreatment system and the targeted light off temperature by the assigned preheating cycle duration to arrive at an amount of power consumption for the heating element 120, 206. Based on the targeted amount of power consumption for the heating element 120, 206, a corresponding duty cycle for the switching arrangement 204 may be determined based on the current voltage and/or current state of charge of the energy source 208 to achieve the desired power flow to the heating element 120, 206. In such implementations, when the resulting duty cycle is anticipated to result in a temperature of the heating element 120, 206 exceeding an overheating threshold temperature, the aftertreatment system preheating service may automatically operate the auxiliary air injection device 126, 214 to avoid overheating, as described in greater detail below.

As described above in the context of FIGS. 1-3, after performing the electrical preheating process 400 at 304 to determine the appropriate duty cycle and duration for operating the electrical heating element 120, 206, the aftertreatment system preheating service at the control module 202 automatically operates the switching arrangement 204 with the determined duty cycle for the determined preheating cycle duration (e.g., at 306 and 314) to achieve the desired rate of heat transfer to the catalyst components 122, 124 to achieve the targeted light off temperature prior to ignition of the engine 108. In this manner, the electrical preheating process 400 optimizes the preheating by either minimizing the preheating cycle duration or otherwise optimizing the duty cycle of the heating element 120, 206 to facilitate achieving the targeted light off temperature within a limited duration of time.

Figure 5:
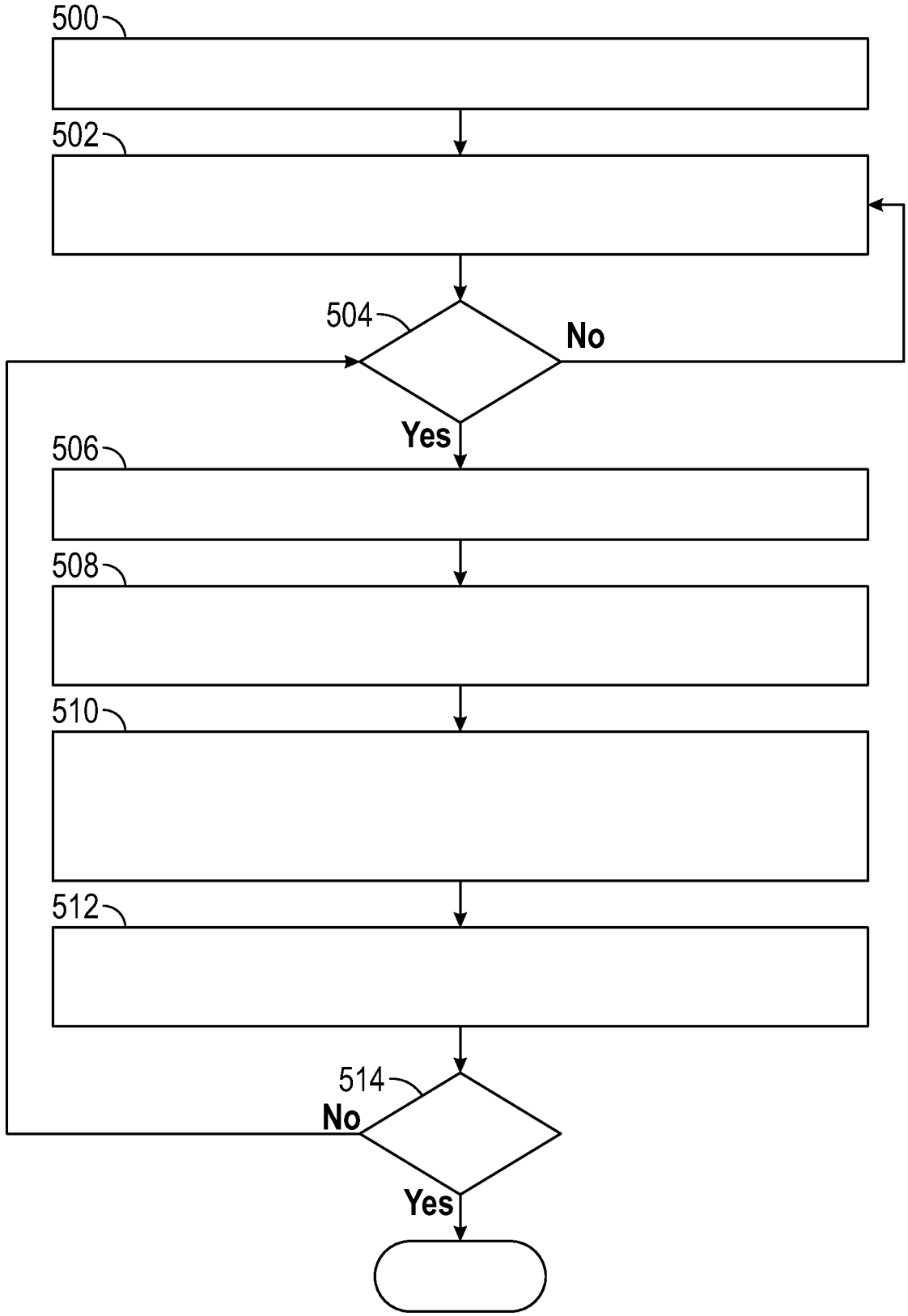
FIG. 5 depicts a flow diagram of an auxiliary preheating process suitable for implementation in connection with the aftertreatment preheating process of FIG. 3 according to one or more implementations described herein.

FIG. 5 depicts an exemplary implementation of an auxiliary preheating process 500 that may be implemented or otherwise performed in connection with the aftertreatment preheating process 300 (e.g., at 308, 310, 312 and 314) to determine whether and how to operate an auxiliary air injection device in connection with an electrical heating element for preheating catalysts or other components associated with emissions control devices and perform additional tasks, functions, and/or operations described herein. For illustrative purposes, the following description may refer to elements mentioned above in connection with FIGS. 1-2. For purposes of explanation, the subject matter may be primarily described herein in the context of the auxiliary preheating process 500 being primarily performed by the aftertreatment system preheating service at the vehicle control module 202.

The illustrated auxiliary preheating process 500 initializes or begins after detecting a potential startup condition and verifying enablement criteria have been satisfied for preheating the aftertreatment system (e.g., at 302). The auxiliary preheating process 500 identifies or otherwise obtains one or more measurements indicative of the current temperature associated with the aftertreatment system at 502 and determines whether or not to enable the auxiliary air injection device at 504 based at least in part on the current temperature of the aftertreatment system. In this regard, the aftertreatment system preheating service delays enabling the auxiliary air injection device 126, 214 until the heating element 120, 206 has generated or produced enough heat such that ambient fluid flow past the heating element 120, 206 will adequately transfer heat to the downstream catalyst components 122, 124. For example, in some implementations, the auxiliary preheating process 500 may verify the current temperature associated with the emissions control devices 104, 106 obtained via the temperature sensing elements 130, 210 is greater than at least a threshold temperature before enabling the auxiliary air injection device 126, 214. In some implementations, the aftertreatment system preheating service may utilize the impedance of the heating element 120, 206 and the determined duty cycle for operating the heating element 120, 206 to model or otherwise estimate a duration of time after initiating operation of the heating element 120, 206 that is required for the temperature of the heating element 120, 206 to reach a threshold temperature, and automatically enable operation of the auxiliary air injection device 126, 214 when that amount of time has elapsed. In this manner, the aftertreatment system preheating service attempts to ensure operation of the auxiliary air injection device 126, 214 will effectively heat the downstream catalyst components 122, 124 (e.g., rather than cooling the heating element 120, 206).

After determining the auxiliary air injection device should be enabled, the auxiliary preheating process 500 automatically operates one or more valves to enable fluid flow from the auxiliary air injection device to the aftertreatment system at 506. The auxiliary preheating process 500 identifies or otherwise obtains one or more measurements indicative of the current temperature associated with the ambient air to be injected at 508 and then calculates or otherwise determines a duty cycle for PWM commands to be utilized to operate the auxiliary air injection device based at least in part on the current ambient air temperature and the difference between the current temperature associated with the aftertreatment system and the targeted temperature at 510. In this regard, the aftertreatment system preheating service may vary the PWM duty cycle utilized to operate the auxiliary air injection device 126, 214 to pulse or vary the fluid flow through the emissions control devices 104, 106 in a manner that is influenced by the current ambient air temperature and the current temperature of the heating element 120, 206 and/or the aftertreatment system to optimize heat transfer to the catalyst components 122, 124. For example, at cooler ambient air temperatures, the aftertreatment system preheating service may utilize a lower PWM duty cycle at lower measurements values for the current temperature of the aftertreatment system to reduce the likelihood of the ambient air flow cooling the aftertreatment system, while, conversely, when the ambient air temperatures are higher and/or the current temperature of the aftertreatment system is closer to the overheating threshold for the heating element 120, 206, the aftertreatment system preheating service may increase the PWM duty cycle to increase the volume of fluid flow to cool the heating element 120, 206 and increase heat transfer to the downstream catalyst components 122, 124. In this regard, the PWM duty cycle for operating the auxiliary air injection device 126, 214 may be optimized to achieve a desired relationship between cooling the heating element 120, 206 and heating the downstream catalyst components 122, 124 that minimizes preheating cycle or otherwise optimizes heat transfer within the preheating cycle.

After determining PWM commands for operating the auxiliary air injection device, the auxiliary heating process 500 automatically operates the auxiliary air injection device with the determined PWM duty cycle in accordance with the determined PWM commands at 512 until detecting or otherwise identifying a termination condition for ceasing operation of the auxiliary air injection device at 514. In this regard, depending on the implementation, various different criteria for terminating operation of the auxiliary air injection device 126, 214 independently from the operation of the heating element 120, 206 may be defined. For example, in some implementations, the aftertreatment system preheating service may automatically disable or terminate operation of the auxiliary air injection device 126, 214 in response to a startup event or ignition of the engine 108. In other implementations, the aftertreatment system preheating service maintains operation of the auxiliary air injection device 126, 214 after a startup event and monitors the temperature of the exhaust gas until terminating operation of the auxiliary air injection device 126, 214 in response to detecting the measured temperature of the exhaust gas within the conduits 114, 116 exceeds the ambient air temperature. Additionally, in some implementations, the aftertreatment system preheating service may automatically disable or terminate operation of the auxiliary air injection device 126, 214 when the amount of elapsed time since initiating operation of the heating element 120, 206 has reached or exceeded the determined preheating cycle duration for the particular type of potential startup condition that was detected. Prior to a termination condition, the loop defined by 504, 506, 508, 510, 512 and 514 may repeat during the duration of the preheating cycle to dynamically vary the PWM duty cycle and corresponding commands for operating the auxiliary air injection device 126, 214 based on the current temperature measurements obtained via the temperature sensing elements 130, 210. In this regard, the PWM duty cycle, and thereby, the rate of fluid flow, may dynamically vary to increase or decrease the amount of fluid flow past the heating elements 120, 206 and through the downstream catalyst components 122, 124 depending on the current thermal condition of the emissions control devices 104, 106 of the aftertreatment system 102.

Figure 6:
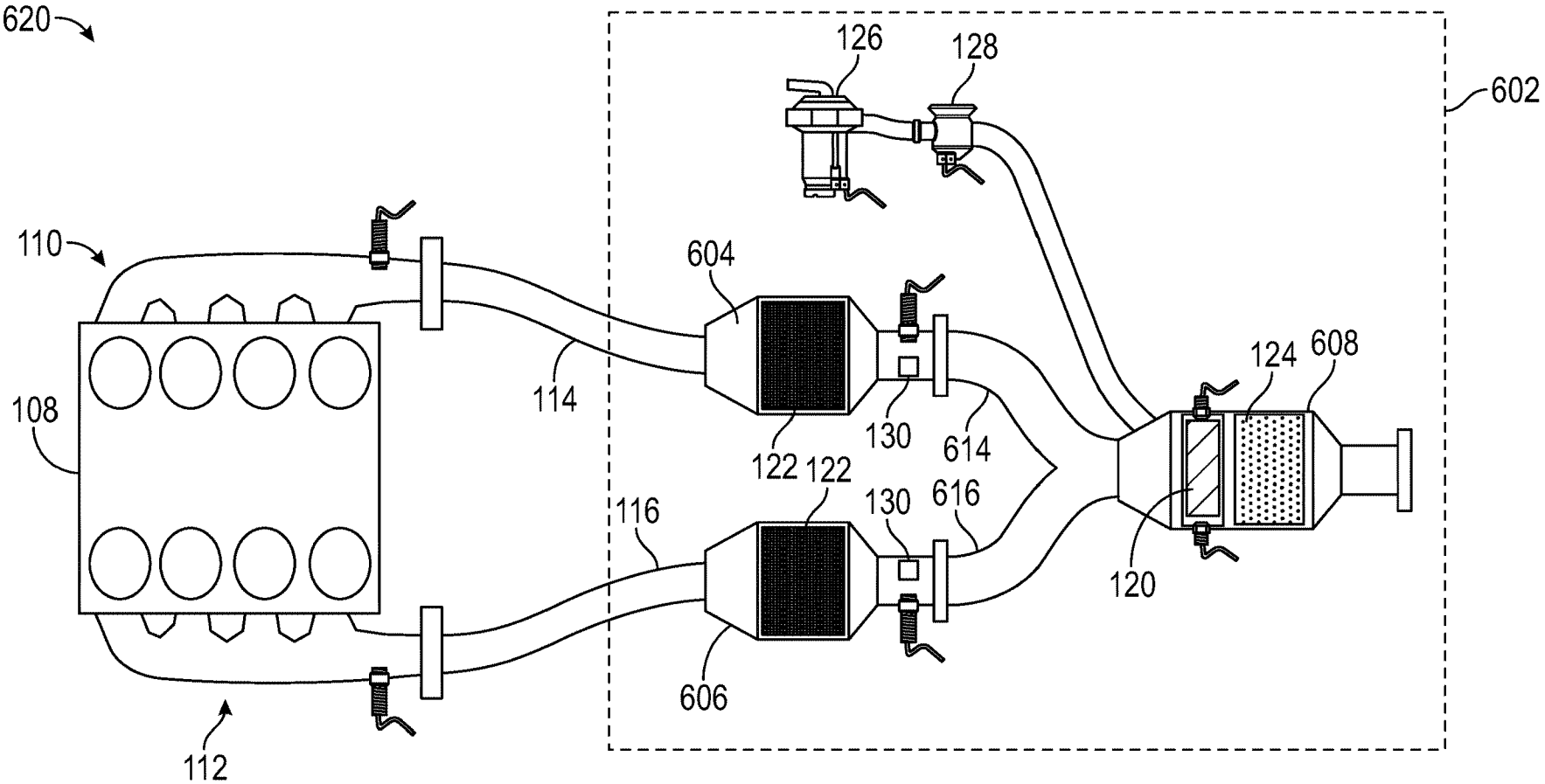
FIG. 6 is a block diagram illustrating a vehicle system suitable for use with the aftertreatment preheating process of FIG. 3 in accordance with various implementations.

FIG. 6 depicts another layout of an exemplary vehicle system 600 having an exhaust gas aftertreatment system 602 that includes multiple emissions control devices 504, 506, 508 downstream of an engine 108. In this regard, FIG. 6 depicts an implementation having dual first stage emissions control devices 604, 606 associated with the respective exhaust conduits 114, 116 from the engine 108, where the respective ducts or conduits 614, 616 for directing exhaust gas flow exiting the respective emissions control devices 604, 606 merge at or before the inlet or intake of a second stage emissions control device 608 downstream of the first stage emissions control devices 604, 606. Various elements depicted in FIG. 6 are similar to counterpart elements described above in the context of FIG. 1 and will not be redundantly described in the context of FIG. 6.

In the implementation of FIG. 6, the heating element 120 is integrated with or otherwise contained within the housing of the downstream second stage emissions control device 608. In exemplary implementations, the first stage emissions control devices 604, 606 are realized as duplicate instances of a catalytic converter including instances of a first catalyst component 122, while the second stage emissions control device 608 includes a second catalyst component 124. In a similar manner as described above, the heating elements 120 is operated prior to ignition or starting of the engine 108 to proactively increase the temperature of the catalyst components 124 of the second stage emissions control device 608 in anticipation of a startup event, and thereby improve the performance and efficiency of the aftertreatment system 602.

In the implementation of FIG. 6, the aftertreatment system 102 includes a single instance of an auxiliary air injection device 126 (and associated valve 128) that is upstream of the second stage emissions control device 608 via an auxiliary duct or conduit between the outlet of the auxiliary air injection device 126 and the inlet or intake of the second stage emissions control device 608. As described above, the auxiliary air injection device 126 may be operated after activation of the heating element 120 but prior to ignition or starting of the engine 108 to provide fluid flow through the second stage emissions control device 608 that heats the catalyst component 124 by virtue of the upstream heating element 120 heating the fluid flow before reaching the catalyst component 124.

It should be noted that in other implementations, the exhaust conduits 114, 116 may be merged upstream of a single instance of an emissions control device 104, 106, such that only a single (or individual) instance of an auxiliary air injection device 126 (and associated valve 128) may be present in connection with a single (or individual) instance of the emissions control device 104, 106. In this regard, the subject matter described herein is not limited to any particular layout or topology for the vehicle system or the aftertreatment system.

While at least one exemplary aspect has been presented in the foregoing detailed description, it should be appreciated that a vast number of variations exist. It should also be appreciated that the exemplary aspect or exemplary aspects are only examples, and are not intended to limit the scope, applicability, or configuration of the disclosure in any way. Rather, the foregoing detailed description will provide those skilled in the art with a convenient road map for implementing the exemplary aspect or exemplary aspects. It should be understood that various changes can be made in the function and arrangement of elements without departing from the scope of the disclosure as set forth in the appended claims and the legal equivalents thereof.

What is claimed is:

1. A method of preheating an aftertreatment system downstream of an engine of a vehicle prior to ignition of the engine, the method comprising:

obtaining, by a control module associated with the vehicle, a first measurement indicative of a current temperature associated with the aftertreatment system;

obtaining, by the control module, a second measurement indicative of a current state of an energy source coupled to a heating element integrated with the aftertreatment system within a housing of an emissions control device of the aftertreatment system and disposed upstream of a catalyst component within the housing of the emissions control device;

determining, by the control module, an amount of electrical energy to be applied to the heating element based at least in part on a difference between the current temperature associated with the aftertreatment system and a target temperature for the aftertreatment system;

automatically enabling, by the control module, current flow from the energy source to the heating element prior to ignition of the engine for a duration of time in a manner that is influenced by the amount of electrical energy to be applied to the heating element and the current state of the energy source; and automatically enabling, by the control module, an auxiliary air injection device to provide fluid flow past the heating element through the aftertreatment system after enabling the current flow from the energy source to the heating element when a temperature associated with the heating element is greater than a threshold.

2. The method of claim 1, wherein automatically enabling the current flow comprises the control module automatically operating a switching arrangement coupled between the energy source and the heating element for the duration of time with a duty cycle, the control module determining the duty cycle based at least in part on the current state of the energy source and the difference between the current temperature associated with the aftertreatment system and the target temperature for the aftertreatment system.

3. The method of claim 2, wherein determining the duty cycle comprises the control module determining the duty cycle to minimize the duration of time for applying the amount of electrical energy based on the current state of the energy source.

4. The method of claim 2, wherein determining the duty cycle comprises the control module determining the duty cycle based at least in part on an overheating threshold temperature associated with the heating element.

5. The method of claim 1, further comprising determining, by the control module, a duty cycle for operating the auxiliary air injection device based at least in part on the current temperature associated with the aftertreatment system, wherein automatically enabling the auxiliary air injection device comprises operating the auxiliary air injection device with the duty cycle.

6. The method of claim 1, further comprising:

detecting, by the control module, a potential startup condition for the engine;

identifying, by the control module, the duration of time based on a type of the potential startup condition; and determining, by the control module, a duty cycle for the current flow from the energy source to the heating element to achieve the amount of electrical energy based at least in part on the duration of time and the current state of the energy source, wherein automatically enabling the current flow comprises automatically operating a switching arrangement coupled between the energy source and the heating element with the duty cycle for the duration of time.

7. The method of claim 1, wherein the heating element comprises a resistive element contained within the housing of the emissions control device of the aftertreatment system.

8. The method of claim 7, wherein:

the target temperature comprises a targeted light off temperature associated with the catalyst component.

9. The method of claim 8, wherein obtaining the first measurement comprises obtaining the first measurement from a temperature sensing element within the housing of the emissions control device, wherein the temperature sensing element is upstream of at least one of the resistive element and the catalyst component.

10. A vehicle system comprising:

an energy source;

an emissions control device including a heating element coupled to the energy source and at least one catalyst component, the heating element being disposed upstream of the at least one catalyst component within a housing of the emissions control device;

a temperature sensing element to obtain a first measurement indicative of a current temperature associated with the emissions control device;

an auxiliary air injection device upstream of the emissions control device to provide a fluid flow past the heating element through the emissions control device; and a control module coupled to the heating element and the energy source, wherein the control module is configurable to:

detect a potential startup condition for an engine upstream of the emissions control device;

obtain a second measurement indicative of a current state of the energy source;

determine an amount of electrical energy to be applied to the heating element based at least in part on a difference between the current temperature and a target temperature for the at least one catalyst component;

automatically enable current flow from the energy source to the heating element for a duration of time in a manner that is influenced by the amount of electrical energy to be applied to the heating element and the current state of the energy source; and automatically enable the auxiliary air injection device to provide the fluid flow past the heating element after enabling the current flow from the energy source to the heating element when a temperature associated with the heating element is greater than a threshold.

11. The vehicle system of claim 10, wherein the control module is configurable to determine a duty cycle for operating the heating element based at least in part on the current state of the energy source and automatically enable the current flow by operating a switching arrangement between the energy source and the heating element in accordance with the duty cycle determined based at least in part on the current state of the energy source.

12. The vehicle system of claim 11, wherein the control module is configurable to determine the duty cycle to minimize the duration of time for achieving the amount of electrical energy applied to the heating element based at least in part on a current voltage of the energy source.

13. The vehicle system of claim 12, wherein the control module is configurable to maximize the duty cycle based at least in part on an overheating threshold temperature associated with the heating element.

14. The vehicle system of claim 10, wherein the control module is configurable to determine a duty cycle for operating the auxiliary air injection device based at least in part on the current temperature and operate the auxiliary air injection device with the duty cycle.

15. A non-transitory computer-readable medium comprising executable instructions that, when executed by a processor, cause the processor to provide an aftertreatment system preheating service configurable to:

obtain a first measurement indicative of a current temperature associated with an aftertreatment system downstream an engine of a vehicle;

obtain a second measurement indicative of a current state of an energy source coupled to a heating element integrated with the aftertreatment system within a housing of an emissions control device of the aftertreatment system and disposed upstream of a catalyst component within the housing of the emissions control device;

determine an amount of electrical energy to be applied to the heating element based at least in part on a difference between the current temperature associated with the aftertreatment system and a target temperature for the aftertreatment system;

automatically enable current flow from the energy source to the heating element for a duration of time prior to ignition of the engine in a manner that is influenced by the amount of electrical energy to be applied to the heating element and the current state of the energy source; and automatically enable an auxiliary air injection device to provide fluid flow past the heating element through the aftertreatment system after enabling the current flow from the energy source to the heating element when a temperature associated with the heating element is greater than a threshold.

16. The non-transitory computer-readable medium of claim 15, wherein the aftertreatment system preheating service is configurable to:

verify the temperature associated with the heating element is greater than the threshold after enabling the current flow; and after verifying the temperature associated with the heating element is greater than the threshold:

determine a duty cycle for operating the auxiliary air injection device based at least in part on the current temperature associated with the aftertreatment system; and automatically operate the auxiliary air injection device with the duty cycle.

* * * * *